United States Patent [19]

Kimura

[11] 4,364,340

[45] Dec. 21, 1982

[54] VEHICULAR ENGINE

[75] Inventor: Hiroshi Kimura, Iwata, Japan

[73] Assignee: Yamaha Hatsudoki Kabushiki Kaisha, Iwata, Japan

[21] Appl. No.: 227,660

[22] Filed: Jan. 23, 1981

[30] Foreign Application Priority Data

Feb. 8, 1980 [JP] Japan ..... 55-15096

[51] Int. Cl.[3] ..... F02B 75/22

[52] U.S. Cl. ..... 123/55 R; 123/52 MV; 55/385 B; 180/219; 180/229

[58] Field of Search ..... 123/55 R, 55 VF, 55 VE, 123/55 VS, 52 MV; 55/385 B, 510, DIG. 28; 180/218, 219, 228, 229

[56] References Cited

U.S. PATENT DOCUMENTS

| | | | |
|---|---|---|---|
| 2,772,668 | 12/1956 | Nystrom et al. | 123/55 R |
| 3,937,484 | 2/1976 | Morioka et al. | 180/219 |
| 4,214,644 | 7/1980 | Matsuda | 123/55 R |
| 4,237,996 | 12/1980 | Matsuda et al. | 180/229 |
| 4,280,582 | 7/1981 | Youyama et al. | 55/385 B |

FOREIGN PATENT DOCUMENTS

| | | | |
|---|---|---|---|
| 2809919 | 9/1979 | Fed. Rep. of Germany | 55/510 |
| 884873 | 7/1942 | France | 55/385 B |
| 737327 | 2/1953 | United Kingdom | 55/385 B |

*Primary Examiner*—P. S. Lall

*Attorney, Agent, or Firm*—Donald D. Mon

[57] ABSTRACT

An induction system for a fuel injection V-type motorcycle engine has a pair of mixing bodies extending upwardly from the intake ports within the V formed by the cylinders. A surging tank is above the mixing bodies and below the fuel tank. An air intake passage is disposed alongside of the surging tank, and an air flow meter is disposed in the intake passage.

5 Claims, 3 Drawing Figures

VEHICULAR ENGINE

DETAILED DESCRIPTION OF THE INVENTION

The present invention relates to an induction system for a vehicular engine, and more particularly for a V-type engine of the type suitable for a motorcycle.

BACKGROUND OF THE INVENTION

In a V-type engine of electronic fuel injection type, in which the cylinders have their intake sides disposed in the inside of the letter "V", this invention contemplates providing mixing bodies which extend upwardly from the intake sides to a surging tank having communication with those mixing bodies. In the electronic fuel injection type engine thus constructed, injectors are disposed in the aforementioned mixing bodies thereby to inject a fuel into the mixing bodies. The rate of the fuel to be injected from those injectors is controlled by the signal coming from an air flow meter which is arranged in an intake passage providing communication between an air cleaner and the surging tank. That air flow meter detects the flow rate of intake air passing through the intake passage in terms of a voltage ratio by means of a potentiometer thereby to provide the injectors with the aforementioned signal based upon the detected value. For the potentiometer to function properly, it is necessary to isolate the air flow meter from a heat source and to place it where it will be protected from water. On the other hand, when the vehicular engine of the electronic fuel injection type thus constructed is to be applied to a motorcycle or the like, it is necessary for the devices to be arranged in a limited space in the motorcycle. In order to meet such severe conditions, it is conceivable that the air flow meter be disposed above the surging tank. In the usual motorcycle or the like, however, since the fuel tank is positioned above the surging tank, the space for the fuel tank has to be sacrificed, if the air flow meter is to be disposed above the surging tank, with the resultant defect that sufficient capacity of the fuel tank cannot be retained.

BRIEF DESCRIPTION OF THE INVENTION

The present invention has been conceived in view of the background thus far described and contemplates to propose a vehicular engine which can sufficiently retain the capacity of a fuel tank without deteriorating the function of the potentiometer of an air flow meter. According to the present invention, there is provided a vehicular engine comprising: a pair of cylinders arranged in the form of a letter "V"; a pair of mixing bodies extending upward from the intake sides of said cylinder, respectively; a surging tank having communication with the upper ends of said mixing bodies and disposed below a fuel tank; an intake passage extending along the side of said surging tank; and an air flow meter arranged in said intake passage. As a result, according to the present invention, since the intake passages with a built-in air flow meter are positioned sideway of the surging tank, the sufficient capacity of the fuel tank can be retained without sacrificing the space for the fuel tank. Moreover, since the air flow meter is arranged in the intake passage which in turn is arranged at a high level at the side of the surging tank, it is isolated from a heat source (i.e., the engine) and is protected from water or the like.

The present invention will now be described in detail in connection with the embodiment thereof with reference to the accompanying drawings.

BRIEF DESCRIPTION OF THE DRAWINGS

FIG. 1 shows the diagrammatical construction of a motorcycle, to which the embodiment of an induction system for vehicular engine according to the present invention is applied. As shown, a pair of cylinders 10 and 12 are arranged in the form of a letter "V", and a surging tank is interposed between those cylinders 10 and 12 and a fuel tank 14. The surging tank 16 is equipped with a pair of mixing bodies 18 and 20 which are arranged to have communications with the intake sides of those cylinders 10 and 12, respectively. At the side of that surging tank 16, moreover, there is disposed an intake passage 22, in which a later-described air flow meter is arranged. That intake passage 22 is made to have communication with a later-described air cleaner 24, through which clean air is sucked and fed to the surging tank 16.

As has been described in the above, the cylinders 10 and 12 are arranged in the V-shaped form and have their respective intake sides 26 and 28 arranged in the letter "V". As shown in FIG. 2, more specifically, the intake sides 26 and 28 are equipped with intake valves 30 and 32, respectively, which are adapted to be opened and closed thereby to feed the combustion chambers with an air-fuel mixture. The aforementioned mixing bodies 18 and 20 are arranged to extend upward from the intake sides 26 and 28 of the cylinders 10 and 12, respectively. The mixing bodies 18 and 20 are slightly inclined upwardly and toward their facing sides and are made to have their upper portions communicating with the surging tank 16. At the facing sides of the mixing bodies 18 and 20, there are mounted a pair of injectors 34 and 36, respectively, which are made operative to inject the fuel in accordance with the signal coming from the later-described air flow meter. In the mixing bodies 18 and 20, moreover, there are pivotted a pair of valve shafts 38 and 40, respectively, to which not-shown throttle valves are attached thereby to control the flow rate of the mixture to be fed to the combustion chambers.

Figure 1:
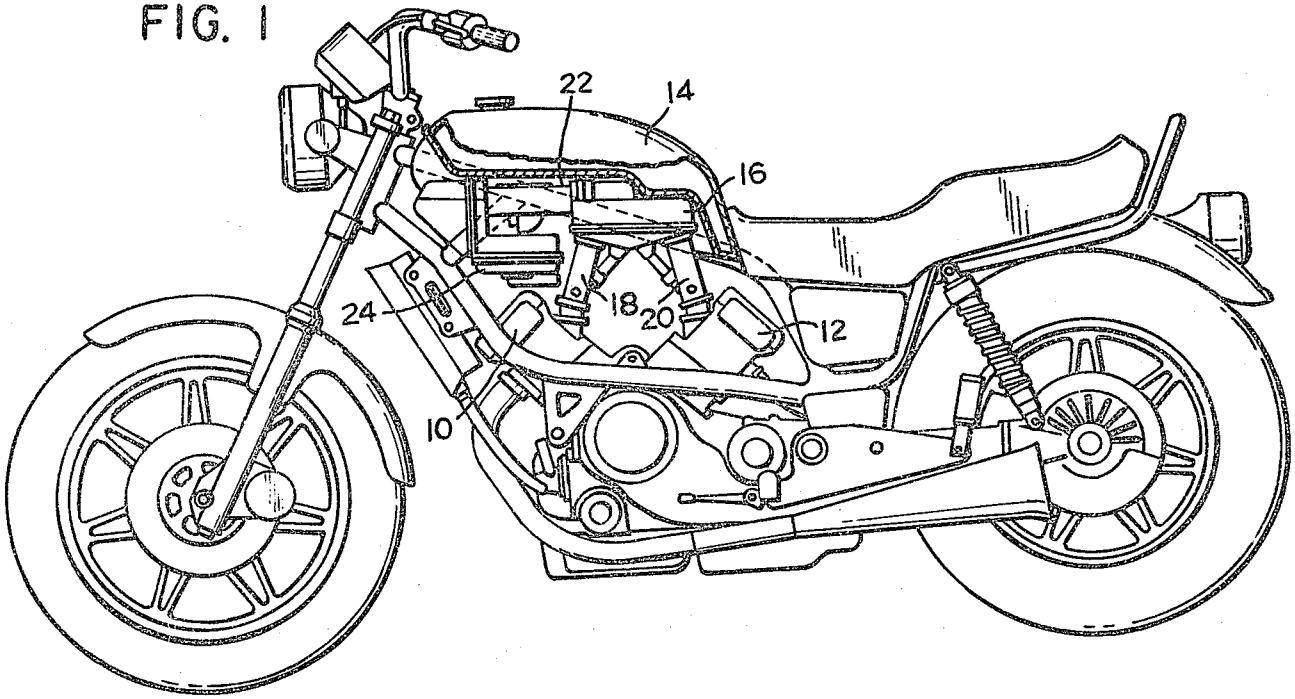
FIG. 1 is a side view of a motorcycle which incorporates the invention.
Figure 2:
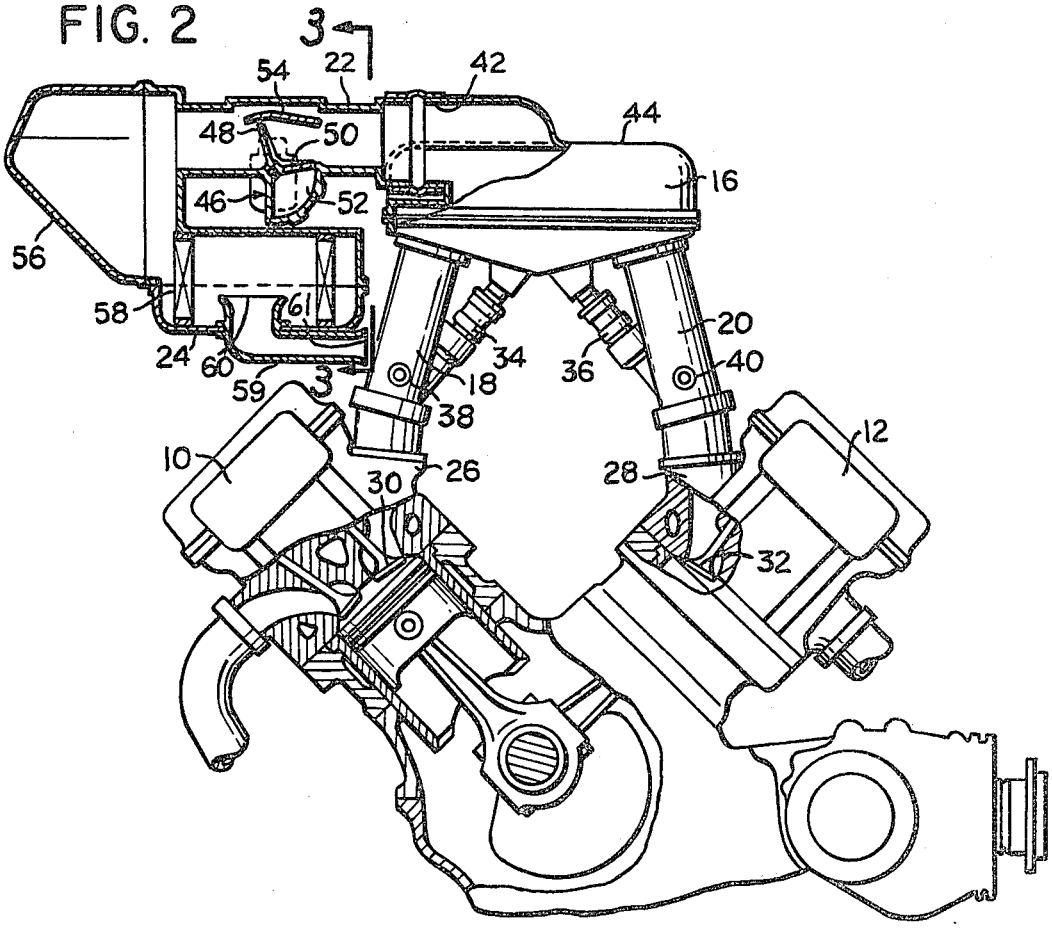
FIG. 2 is a side view, partly in cutaway cross-section, showing the invention in greater detail.

The aforementioned intake passage is arranged at the side of the surging tank, i.e., at the front of the front portion of the vehicle and is made to have communication with the surging tank 16 at a connecting portion 42. Moreover, the intake passage 22 is arranged, as shown in FIG. 2, such that its upper half is positioned at a higher level than the upper side 44 of the surging tank 16. Still moreover, the intake passage 22 is equipped with the air flow meter 46. In the intake passage 22, more specifically, there is arranged a measuring plate 48 which constitutes the air flow meter 46, and a compensation plate 50 is integrally attached to that measuring plate 48 generally at a right angle. This measuring plate 48 is opened to such an angle by the action of the air flowing through the intake passage 22 as is balanced with the action of a not-shown return spring so that the flow rate of the intake air is converted into and detected in terms of a voltage ratio in accordance with that open angle by the action of a not-shown potentiometer which is coaxially connected to the measuring plate 48. As a result, the detected value of that potentiometer controls the flow rate of the fuel to be injected by the aforementioned injectors 34 and 36. On the other hand, in case the measuring plate 48 is revolved in accordance with the change in the flow rate of the intake air, the compensation plate 50 is accommodated in a damping jumper 52, whereby a reverse torque is generated in the compensation plate 50 thereby to stabilize the response of the air flow meter system. Incidentally, a bypass passage 54 formed in the intake passage 22 is the passage for a slow system.

Figure 3:
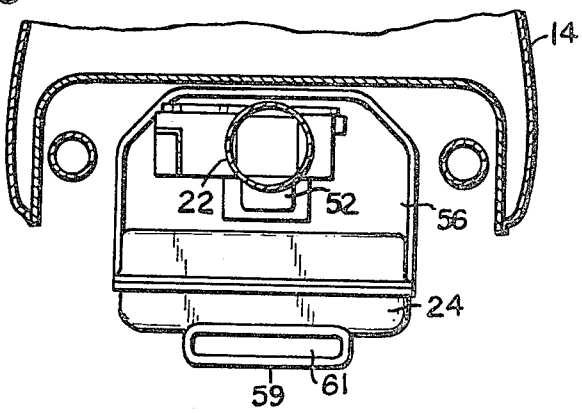
FIG. 3 is a cross-section taken at line III—III in FIG. 2.

The intake passage 22 has its terminal portion communicating with the upper portion of a casing 56 which has its lower portion communicating with the air cleaner 24. In this air cleaner 24, as shown in FIG. 2, there is arranged a cylindrical element 58, into which the outlet 60 of an L-shaped passage 59 is opened. This passage 59 forms an air inlet port 61, which is formed into such a rectangular shape as is shown in FIG. 3. This air inlet port 61 is opened into the inside of the vehicle and is so devised that it will not suck any water, dust or the like.

The operation of the embodiment thus constructed according to the present invention will be described in the following. First of all, the air sucked from the passage 59 has dust or the like filtered off by the action of the element 58 in the air cleaner 24, and the air having passed through the element 58 is then fed through the casing 56 to the intake passage 22. In this intake passage 22, the measuring plate 48 is revolved in accordance with the flow rate of the air passing therethrough so that the air flow rate is detected to instruct the injectors 34 and 36 of the rate of the fuel to be injected thereby. The air having passed through the intake passage 22 enters the surging tank 16 from the connecting portion 42 and then has its pulsations or the like removed and is fed to the respective mixing bodies 18 and 20.

According to the embodiment thus far described, the intake passage 22 for feeding the surging tank 16 with the intake air is disposed sideway of the surging tank 16 and is equipped therein with the air flow meter 46. As a result, the fuel tank 14 disposed above the surging tank 16 can retain its sufficient capacity without sacrificing its space. Moreover, since the air flow meter 46 is spaced at a predetermined distance from the cylinders 10 and 12, the meter 46 itself is not heated by the latter. Moreover, since the air flow meter 46 is disposed above the air cleaner 24 and at the side of the surging tank 16, it is protected from water or the like.

As has been described hereinbefore, according to the present invention, the vehicular engine comprises: a pair of cylinders arranged in the form of a letter "V"; a pair of mixing bodies extending upward from the intake sides of said cylinders, respectively; a surging tank having communication with the upper ends of said mixing bodies and disposed below a fuel tank; an intake passage extending along the side of said surging tank; and an air flow meter arranged in said intake passage. As a result, the fuel tank can retain its sufficient capacity without having its space sacrificed. Moreover, since the air flow meter is arranged in the intake passage which is positioned at a high level at the side of the surging tank, it can be protected from water or the like.

I claim:

1. In combination with a motorcycle having a frame, a fuel tank at an upper elevation on said frame, and a V-type fuel injection type engine mounted to said frame beneath said fuel tank, said engine having a pair of cylinders forming a V, with intake ports inside said V, an induction system comprising: a pair of mixing bodies, each rising from a respective one of said intake ports; a surging tank above and discharging into said mixing bodies, said surging tank being disposed beneath said fuel tank and above said engine; an air intake passage disposed at the side of said surging tank; and an air flow meter in said air intake passage.

2. A combination according to claim 1 in which said air intake passage extends downwardly to an air cleaner, and from said air cleaner to a region within said frame where it is protected from entry of water.

3. A combination according to claim 2 in which said air intake passage extends forwardly from said surging tank, then downwardly and then rearwardly, and opens rearwardly.

4. A combination according to claim 2 in which a portion of said air intake passage is disposed at an elevation higher than the top of said surging tank.

5. A combination according to claim 4 in which said air intake passage extends forwardly from said surging tank, then downwardly and then rearwardly, and opens rearwardly.

* * * * *